United States Patent [19]

Honacker

[11] 4,246,010

[45] Jan. 20, 1981

[54] ELECTRODE SUPPORTING BASE FOR ELECTROSTATIC PRECIPITATORS

[75] Inventor: Horst Honacker, Paradise Valley, Ariz.

[73] Assignee: Envirotech Corporation, Menlo Park, Calif.

[21] Appl. No.: 682,217

[22] Filed: May 3, 1976

Related U.S. Application Data

[63] Continuation-in-part of Ser. No. 588,224, Jun. 19, 1975, abandoned.

[51] Int. Cl.[3] ..... B03C 3/36; B03C 3/49; B03C 3/78

[52] U.S. Cl. ..... 55/119; 55/129; 55/140; 55/154; 55/241; 55/DIG. 38

[58] Field of Search ..... 55/117–120, 55/122, 128–130, 133, 140–143, 145, 154, 226, 240–242, 418, 423, 428, 466, DIG. 38

[56] References Cited

U.S. PATENT DOCUMENTS

| | | | |
|---|---|---|---|
| 2,476,248 | 7/1949 | MacKenzie | 55/118 |
| 2,926,749 | 3/1960 | Oswald | 55/141 X |
| 3,238,702 | 3/1966 | DeSeversky | 55/DIG. 38 X |
| 3,315,444 | 4/1967 | DeSeversky | 55/119 X |
| 3,511,030 | 5/1970 | Hall et al. | 55/154 X |
| 3,664,092 | 5/1972 | Vincent | 55/423 X |
| 3,742,681 | 7/1973 | DeSeversky | 55/119 |
| 3,785,125 | 1/1974 | DeSeversky | 55/241 X |
| 3,792,568 | 2/1974 | Gundlach et al. | 55/423 X |
| 3,856,476 | 12/1974 | DeSeversky | 55/128 X |

FOREIGN PATENT DOCUMENTS

| | | | |
|---|---|---|---|
| 1204 | 3/1931 | Australia | 55/140 |

*Primary Examiner*—Kathleen J. Prunner
*Attorney, Agent, or Firm*—Robert E. Krebs

[57] ABSTRACT

The disclosure relates to a base for supporting hollow cylindrical and circular in cross section collector electrodes for an electrostatic precipitator. The base comprises a central portion and is generally circular; a plurality of arcuate venturi and collector trough assemblies which are generally circular and which intersect radially disposed drain troughs; said venturi and collector trough assemblies being concentric with said center portion of said base and drain troughs extending radially outward from said center portion; a circular wall structure secured to outer ends of said drain troughs; fixture means for securing said collector electrodes on said drain troughs; uppermost portions of said drain troughs and said venturi and collector troughs being substantially flush with each other and said venturi and collector trough assemblies disposed on a common plane to provide for uniform laminar flow relative to the collector electrodes.

2 Claims, 5 Drawing Figures

ELECTRODE SUPPORTING BASE FOR ELECTROSTATIC PRECIPITATORS

This application is a continuation-in-part of my copending application Ser. No. 588,224, filed June 19, 1975, abandoned.

PRIOR ART

The U.S. Pat. Nos. 3,315,444; 3,742,681; 3,785,125 and 3,856,476 are believed to be the most pertinent prior art relating to the subject matter of this application.

BACKGROUND OF THE INVENTION

Prior art electrostatic precipitators, wherein there are concentric spaced apart generally circular in cross section cylindrical electrode structures have been provided with supporting base elements for carrying the electrodes of such electrostatic precipitators, and in the construction of supporting bases for such collector electrodes, it has been a problem to properly assemble drain troughs as well as collector troughs and also inlet venturi structures all within a reasonable plane and so as to provide for uniformity of structure as well as compactness and efficient aerodynamic operation thereof.

SUMMARY OF THE INVENTION

The present invention relates to a circular collector electrode supporting base means for electrostatic precipitators. This base means comprises a plurality of generally circular venturi and collector trough assemblies which intersect radially disposed drain trough assemblies which extend from a central portion of the base to a peripheral generally circular frame structure. The venturi and collector trough assemblies combine generally U-shaped venturi structure with the collector trough structure so that the generally U-shaped venturi structures actually perform as collector trough assemblies beneath the collector electrode structures of electrostatic precipitators wherein the collector electrodes are supported on said base. The generally circular venturi and collector trough assemblies are composed of a plurality of arcuate sections disposed and secured between the radially disposed drain troughs so that all of the troughs structures may be substantially flush with each other on a horizontal plane at which lower edge portions of generally circular in cross section hollow cylindrical collector electrodes are supported. The arcuate sections of the venturi and collector trough assemblies are disposed below lower edges of the generally circular in cross section collector electrodes and aerodynamic venturi structures of the venturi and collector trough assemblies are disposed on a substantially common plane so that uniform aerodynamic flow functions may be accomplished throughout the entire inlet area of the base in order to provide substantially laminar flow of pneumatic fluid vertically relative to the generally vertical surfaces of the collector electrodes. Furthermore, the foregoing arrangement provides for a very compact structure of nominal vertical dimensions which functions with the highest efficiency comparable to the compactness of the structure.

The venturi and collector trough assemblies consist of a substantially U-shaped in cross section venturi structure having opposed convex surface portions at opposite sides thereof with inner walls facing each other and an aerodynamic leading edge or flow receiving portion interconnecting the opposed convex portion and these convex portions of adjacent venturi structures face each other so as to provide for converging diverging flow passages directly below and between adjacent wet walls of collector electrodes; said walls facing each other and subject to laminar flow as influenced by the converging diverging venturi structures provided by the opposed adjacent convex surfaces of the venturi structures which also form drain troughs below respective collector electrodes.

The drain trough structures of the collector electrode base of the invention are radially disposed and are substantially U-shaped in cross section and are provided with openings in opposite sides thereof which communicate with the bottom portions of the arcuate venturi and collector troughs which are disposed between the radially directed drain troughs.

Opposite ends of the arcuate sections of the venturi and collector drain troughs are provided with laterally extended flanges which are bolted to the radially directed drain troughs so as to hold the venturi and collector drain trough assemblies in water tight and rigid relationship with the radially directed drain troughs.

Coupler means on the radially directed drain troughs provide for hold on means such as bolts or the like for securing lower edges of the collector electrodes onto the upper surfaces of the base and this upper surface is substantially on a common plane with all of the venturi and collector trough assemblies and the drain trough structures. Thus aerodynamic venturi structures of the venturi and collector trough assemblies are disposed between the radially directed drain troughs and all of the aerodynamic functions of the venturi structures occur on a common plane so as to provide for uniform pneumatic flow characteristics of the fluids passing through the venturi structures and into laminar flow relationship with the wet wall surfaces of the collector electrodes. The base structure of the invention is primarily a support for wet wall collector electrodes of generally circular cross section and the base functions to provide for water collection from the lowermost edges of the collector electrodes and the draining of this water to a disposal area so that contaminates contained in the water may be properly collected and conducted to a suitable sump or other disposal area as desired.

Accordingly, it is an object of the present invention to provide an improved base structure for supporting circular in cross section collector electrodes of electrostatic precipitators and also to provide a combined venturi structure and collector trough means disposed below the collector electrodes for collecting water which drains from the wet walls of the collector electrodes and also to provide for converging diverging venturi structure between adjacent walls of the collector electrodes and whereby the collector trough drain structures and venturi structures are combined as a single structural entity.

Another object of the invention is to provide a novel collector electrode supporting base means for electrostatic precipitators which provides for desirable water collector and drain functions as well as a uniform support for aerodynamic venturi structures on a common plane at the inlet edges of the collector electrodes and further, to provide structural support for the collector electrodes in a manner which is rigid and will maintain accurate spaced relationship of the collector electrodes as well as axial alignment thereof.

Another object of the invention is to provide a base for collector electrodes of an electrostatic precipitator which is very rigid in proportion to the structural arrangement thereof and which is also very compact in vertical dimensions when used as a combined structural support, water drain means and aerodynamic venturi supporting structure.

Another object of the invention is to provide a collector electrode supporting base for electrostatic precipitators having novel means for securing the lower edges of collector electrodes thereto and for the access of a suitable wrench for engaging bolts which secure the lower portions of the collector electrodes to the base.

Further objects and advantages of the invention may be apparent from the following specification, appended claims and accompanying drawings.

DESCRIPTION OF THE PREFERRED EMBODIMENTS

Figure 1:
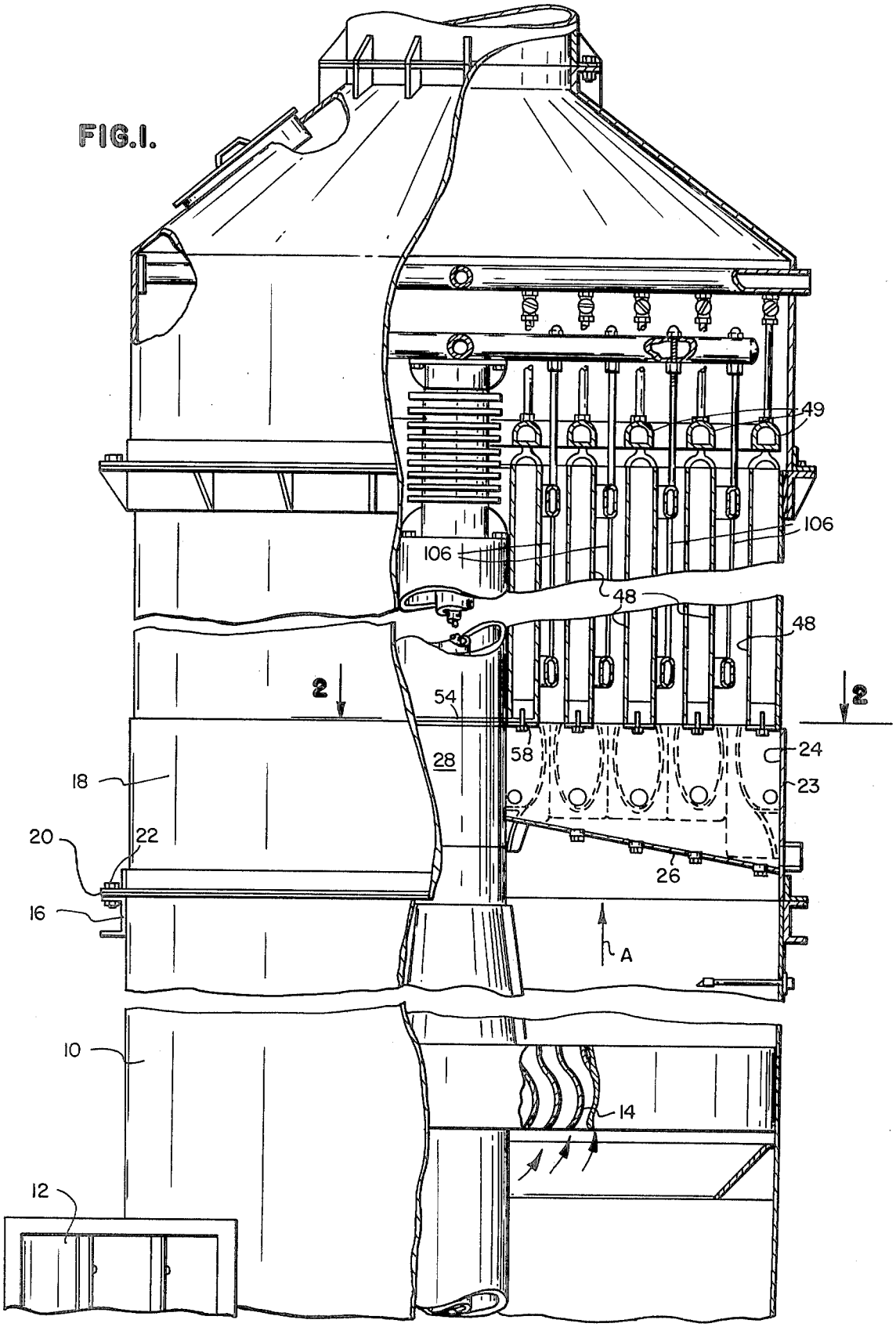
FIG. 1 is a fragmentary side elevational view of an electrostatic precipitator showing an electrode supporting base for electrostatic precipitators.

The electrostatic precipitator, as shown in FIG. 1 of the drawings is provided with a housing 10 having a tangential air inlet 12 wherein air is induced to flow as indicated by arrows into straightening vanes 14 which direct pneumatic flow upwardly in a generally axial direction as indicated by an arrow A in FIG. 1 of the drawings. Supported on the housing 10 by means of a flange structure 16 is a collector electrode supporting base 18.

This base 18 is provided with a flange 20 which is an annular peripheral flange matching the annular flange 16 and these flanges are bolted together by bolts 22, all as shown best in FIG. 1 of the drawings.

The electrode base 18 is provided with a generally circular peripheral wall 23 made of structural steel or the like. Welded or otherwise secured to an inner surface 24 of the wall 23 are radially disposed drain troughs 26. These drain troughs 26 are U-shaped in cross section as shown in FIG. 3 of the drawings and extend radially inward from the surface 24 of the wall 23 to a central hollow cylindrical hub portion 28 to which the drain troughs 26 are welded or otherwise suitably secured.

Figure 4:
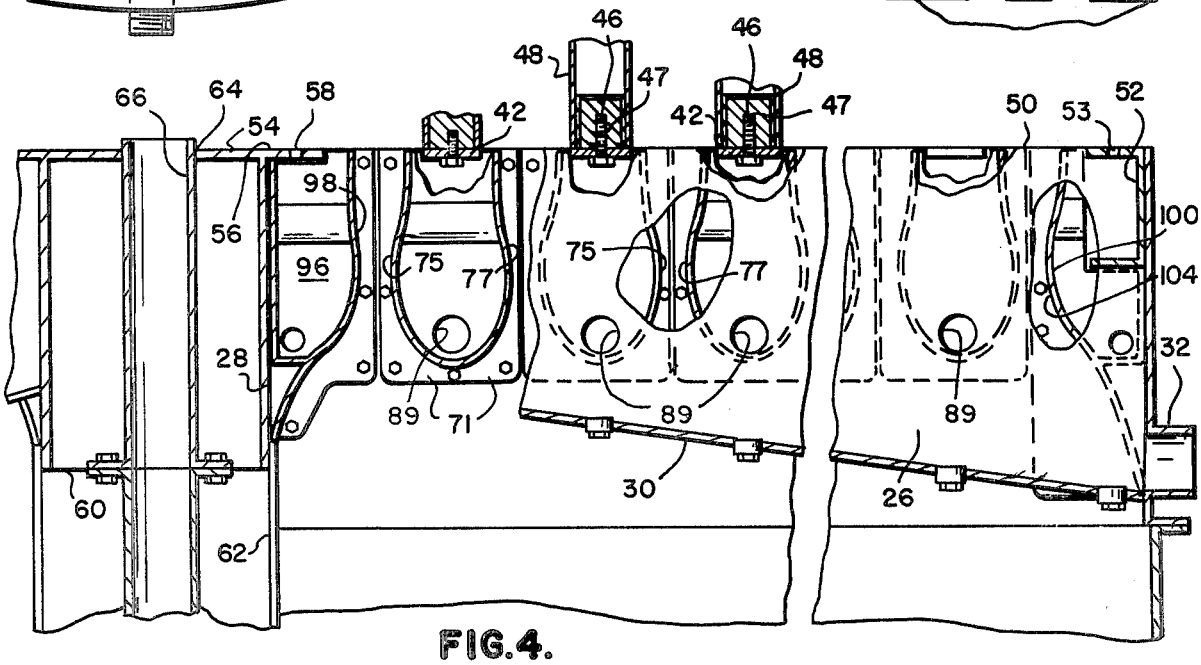
FIG. 4 is an enlarged fragmentary sectional view taken from the line 4—4 of FIG. 2.

As shown best in FIG. 4 of the drawings, a bottom portion 30 of each drain trough 26 is declined from the central hub portion 28 to the outer circular wall 23 so that water will drain towards the wall 23 and outwardly through a suitable outlet fitting 32 which may be properly screwthreaded to receive a conventional plumbing drain fixture or the like.

Figure 3:
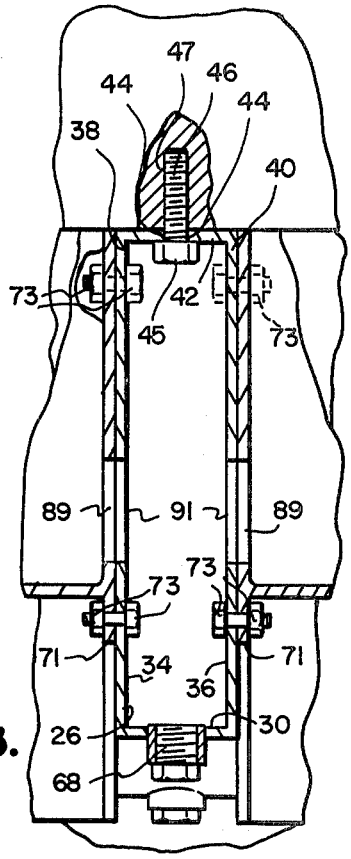
FIG. 3 is an enlarged fragmentary sectional view taken from the line 3—3 of FIG. 2.

Each drain trough 26 is shown in cross section in FIG. 3 of the drawings and is provided with opposite upwardly extending side portions 34 and 36 which are integral with the bottom 30 thereof.

Welded to and connecting between the upper edge portions 38 and 40 of the respective side portions 34 and 36 are fixture receiving plates 42 having openings 44 therein. These openings 44 receive bolts or cap screws 46 which are screwthreaded into internally screwthreaded portions 47 of the collector electrodes 48. These internally screwthreaded portions 47 may be blocks of resin or any other suitable internally screwthreaded means imbedded in the interior or generally central portion of each collector electrode at its normally lower edge or end.

It will be seen that the connector plates 42 are all substantially flush with the upper edges 38 and 40 of the drain troughs 26 and that these plates 42 are shown in FIG. 4 of the drawings and are all disposed on a substantially common horizontal plane relative to each other; this plane being at the upper edges 38 and 40 of the drain troughs 26 and at the inlet edges of the collector electrodes 48.

Secured in flush relation with the upper edge 50 of the base wall structure 23 is an arcuate channel shaped in cross section member 52 which extends between each of the radially disposed drain troughs 26 and suitable openings 53 are provided in this member 52 for receiving bolts such as the bolts 46 shown in FIG. 3 of the drawings and for holding the outermost collector electrode 48 securely in position on the base 18.

The central hub portion 28 of the base 18 is provided with an upper end plate 54 which is generally circular and provided with an extending flange portion 56 having openings 58 therein adapted to receive bolts such as the bolts 46 for holding the innermost one of the collector electrodes 48.

A lower portion 60 of the hub portion 28 is adapted to fit into a hollow tubular member 62 which extends centrally through the housing 10 but which is no part of the base structure. The top portion 54 of the hub 28 is provided with an opening 64 through which a conduit 66 extends. This conduit 66 is no part of the invention relative to the base structure but serves to provide an area in which a high voltage electrical conductor may extend upward to electrical discharge electrode structures such as discharge electrodes 106, shown in FIG. 1 of the drawings.

As shown in FIGS. 3 and 4 of the drawings, conventional pipe lugs or other suitable closures 68 are screwthreaded in the bottom portion 30 of the drain troughs 26 and these plugs 68, when removed, provide access openings through which a wrench may be inserted for gaining access to the heads 45 of the bolts 46 when it is desired to secure or release the collector electrodes 48 relative to the connector plates 42, as hereinbefore described.

Figure 2:
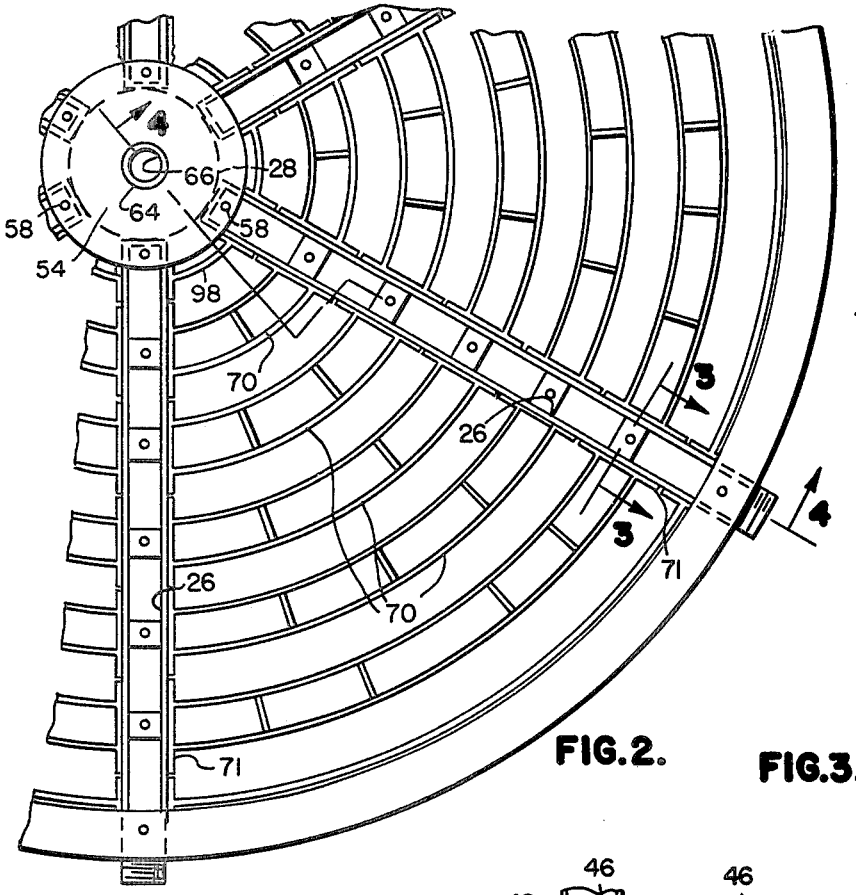
FIG. 2 is an enlarged fragmentary planned sectional view taken from the line 2—2 of FIG. 1.

As shown best in FIGS. 2 and 4 of the drawings, the base of the invention is provided with a plurality of venturi and collector trough assemblies 70. These trough assemblies are generally circular and correspond with the circular cross section of the collector electrodes 48. These trough assemblies are U-shaped in vertical cross section and slightly wider than the collector electrodes 48, as shown in FIG. 4 of the drawings, so that water draining downward along opposite sides of the surfaces of the collector electrodes will drain into the generally U-shaped cross section of the venturi and collector trough assemblies 70.

Each assembly 70, although generally circular, is composed of a plurality of sections which are abutted to the sides 34 and 36 of the radially disposed drain troughs 26 and flanges 71 at opposite ends of the sections are bolted to the radially disposed troughs 26 at their opposite side walls 34 and 36, as shown best in FIGS. 3 and 4 of the drawings, so as to form a seal relative to said sides 34 and 36 and thus, several arcuate sections of channel shaped venturi trough structure are required to form each circular trough assembly 70.

With reference to FIGS. 3 and 4 of the drawings, it will be seen that each section of the circular trough assemblies is provided with the flanges 71 on opposite ends thereof and these flanges 71, as shown in FIG. 3 of the drawings, are secured by bolts 73 to the opposite sides 34 and 36 of the drain troughs 26.

Figure 5:
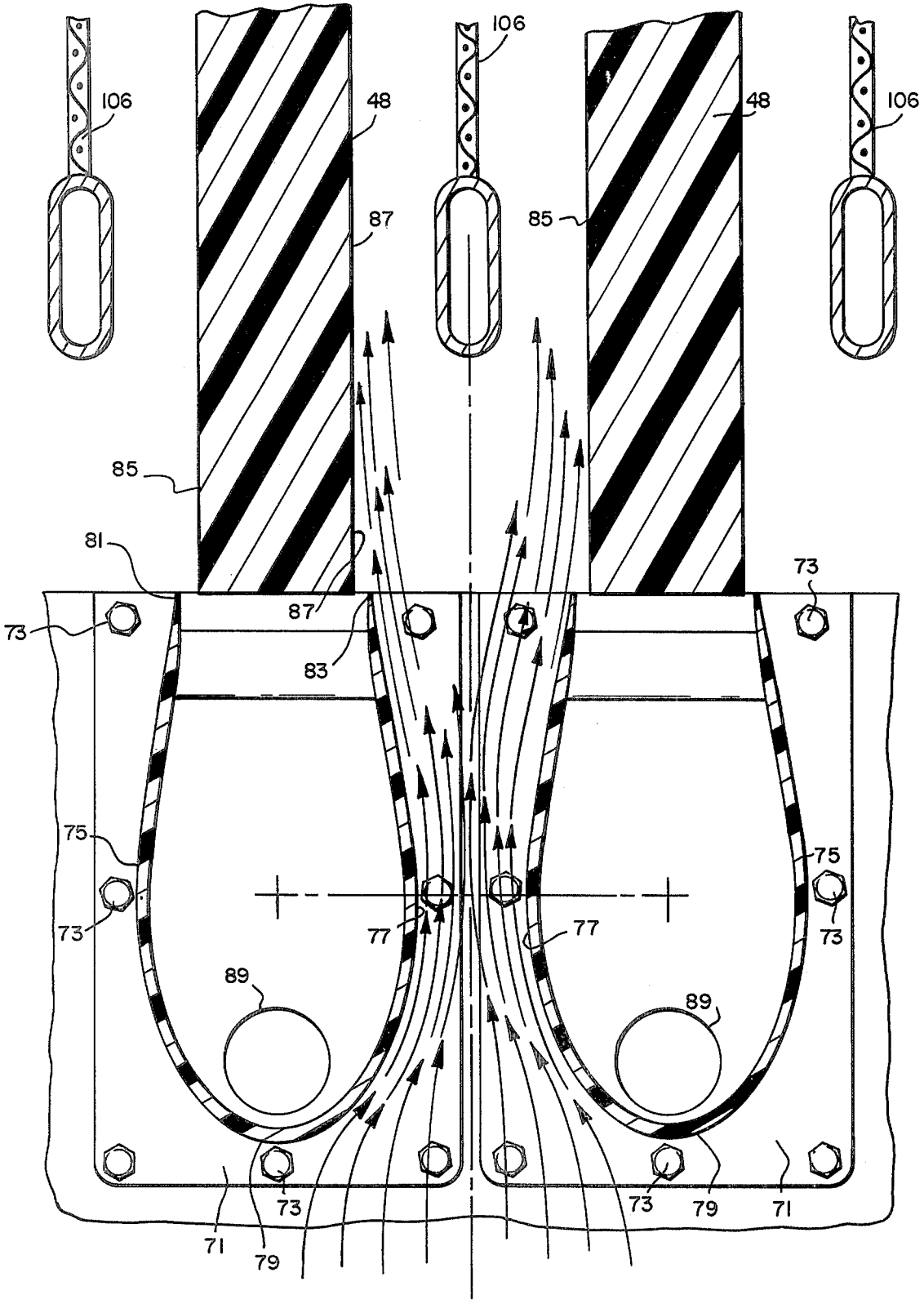
FIG. 5 is an enlarged fragmentary sectional view taken on the same plane as that shown in FIG. 4 and showing by arrows the venturi structure and its converging diverging nozzle structure and the relative laminar flow influences induced thereby.

The individual venturi and collector trough sections, as shown in FIGS. 4 and 5 of the drawings, are generally U-shaped in cross section and are provided with opposed convex surfaces 75 and 77 which are interconnected by an aerodynamically curved leading edge portion 79 and spaced apart upper edges 81 and 83 of the respective convex sides 75 and 77 are spaced apart slightly wider than respective opposite sides 85 and 87 of the respective collector electrodes 48.

The collector electrodes 48 are provided with water delivery conduits 49 at their upper edges which deliver water downwardly along the opposite sides of these collector electrodes 48 and the upper edges 81 and 83 of the venturi and collector trough assemblies are spaced apart slightly wider than the opposite sides 85 and 87 so that the water passing downwardly on the opposite surfaces of the collector electrodes 48 drains into the venturi and collector trough assemblies and an opening 89 in each flange 71 communicates with a corresponding opening 91 in a respective side 34 or 36 of the radially directed troughs 26 as shown best in FIG. 3 of the drawings.

The openings aligned with the openings 89 are designated 91 in FIG. 3 of the drawings. As shown in FIG. 5 of the drawings, adjacent convex surfaces 77 of adjacent venturi and collector trough assemblies provide a converging diverging venturi structure which, as shown by arrows in FIG. 5, provide for a laminar flow relationship of air which passes upward into adjacent relation with the respective facing sides 85 and 87 of the adjacent collector electrodes 48.

It will be seen that the venturi structures shown in FIG. 5 of the drawings are on a common plane and therefore provide for uniform venturi functions so as to provide for equal laminar flow adjacent the facing surfaces 87 and 85 of the collector electrodes 48.

It will be appreciated that the venturi structures are generally U-shaped in cross section and having opposed convex sides provide for the aerodynamic venturies hereinbefore described and also function as collector trough structures to receive water or other liquid which drains downwardly from opposite sides of each collector electrode directly located thereabove.

The innermost collector trough, designated 96 in FIG. 4 of the drawings, is coupled to the central hub portion 28 and secured to this collector trough portion 96 is a half section venturi furring 98. This furring 98 is provided with a convex surface adapted to cooperate as a half portion of a venturi structure relative to an adjacent convex wall or surface 75 of one of the adjacent venturi structures such as disclosed in FIG. 5 of the drawings.

Likewise, a venturi half section furring structure 100 is disposed below an outermost collector electrode 48 and is coupled to the circular wall 23 of the base structure. This furring structure is provided with a convex surface 104 which corresponds to an adjacent convex surface 75 of an adjacent venturi structure such as hereinbefore described.

It will be obvious to those skilled in the art that the various venturi structures hereinbefore described are all disposed on a substantially corresponding horizontal plane and that all of the lower edges of the collector electrodes 48 are disposed on a substantially common plane and the structural support as well as the water drain features of the base are all integrated with the aerodynamic functions of the venturi structures and these features all provide for a very compact strong base structure in a vertical direction and which is therefore nominal in its elevational dimension and which is specifically adapted for use in supporting a plurality of concentric spaced apart circular in cross section collector electrodes 48 of an electrostatic precipitator. It will be seen that the venturi structures not only direct flow between the respective collector electrodes but also collect water which drains therefrom and that discharge electrodes 106 as shown in FIG. 1 of the drawings are disposed between the respective collector electrodes 48 in the air flow path of the respective venturi structures, as shown best in FIG. 5 of the drawings.

It will be obvious to those skilled in the art that various modifications may be resorted to without departing from the spirit of the invention.

I claim:

1. In an electrostatic precipitator including a plurality of vertical substantially cylindrical wet wall collector electrodes spaced apart from each other concentrically about a cylindrical axis, each collector electrode having a normally lower end;

a plurality of converging diverging venturi structures, each venturi structure being mounted under the lower end of a corresponding one of said collector electrodes; said venturi structure being substantially U-shaped in cross section in a vertical plane containing said cylindrical axis, said venturi structure having a curved bottom portion and two upwardly extending side portions thereby forming a liquid collector trough, said bottom portion forming a leading edge of said venturi structure, each of said side portions having a convex outer surface ending in an upper edge of said venturi structure, the upper edges of said venturi structure presenting an open top of said venturi structure beneath the lower end of the collector electrode with which the venturi structure is associated;

means for delivering liquid to upper portions of the walls of said wet wall collector electrodes;

a base supporting said collector electrodes;

said venturi structures being supported by said base below said collector electrodes; the open top of each of said venturi structures being disposed to receive liquid which gravitates from a corresponding one of said collector electrodes; said venturi structures thus being liquid collec or troughs as well as providing for laminar flow of gas upward adjacent the walls of said collector electrodes;

said base including a plurality of drain troughs, said drain troughs being radially disposed with respect to said cylindrical axis and spaced apart from each other; each drain trough being generally U-shaped in cross section in a vertical plane perpendicular to a radius extending from said cylindrical axis; each drain trough having a bottom portion and two upwardly extending side walls; said side walls of said drain troughs all ending in a horizontal plane;

said lower ends of said collector electrodes being positioned substantially at said horizontal plane; said venturi structures and said collector electrodes being supported on said drain troughs; said collector electrodes being circular in cross section in a horizontal plane; said venturi structures being composed of arcuate sections, each arcuate section being disposed between and abutted to the upwardly extending side walls of adjacent drain troughs; said venturi structures communicating with said radially disposed drain troughs through openings in said side walls of said drain troughs so as to permit liquid to flow from said venturi structures into said radially disposed drain troughs.

2. An electrostatic precipitator including: a plurality of vertical concentrically spaced substantially cylindrical wet wall collector electrodes having normally lower ends, said lower ends all being supported in a horizontal plane; converging diverging venturi structures disposed at said normally lower ends of said collector electrodes; said venturi structures being substantially U-shaped in cross section; means for delivering liquid to upper portions of said collector electrodes; said U-shaped in cross section venturi structures having opposed spaced apart walls; each wall having an outer convex surface and an inner surface; each venturi structure having a bottom portion; said walls each being connected together by said bottom portion; said bottom portion being aerodynamically curved for directing upwardly flowing gas along the outer surfaces of said walls of said venturi structure; each of said opposed spaced apart walls of said venturi structures having an upper edge spaced from said curved bottom portion; said upper edges of each venturi structure being spaced apart from each other a distance greater than the thickness of the respective collector electrode disposed thereabove; said venturi structures thus being disposed to receive liquid which drains from respective collector electrodes; said venturi structures thus being liquid collector troughs as well as providing laminar flow of gas upward against said collector electrodes; a base supporting said collector electrodes and said venturi structures; said base being provided with radially disposed drain trough structures which are spaced apart relative to each other; said venturi structures and said collector electrodes being supported on said radially disposed drain trough structures; said collector electrodes being circular in horizontal cross section; said venturi structures being composed of arcuate sections disposed between and abutted to said radially disposed drain trough structures; said venturi structures communicating with the interior of said radially disposed drain trough structures whereby liquid collected in said venturi structures drains into said radially disposed drain trough structures.

* * * * *